United States Patent [19]

Limque et al.

[11] 4,168,186

[45] Sep. 18, 1979

[54] METHOD FOR CONTROL OF THE CARBURIZATION OF PARTS IN A VACUUM FURNACE

[75] Inventors: Ferdinand Limque, Berg en Dal, Netherlands; Franz Bless, Kleve, Fed. Rep. of Germany

[73] Assignee: Ipsen Industries International GmbH, Kleve, Fed. Rep. of Germany

[21] Appl. No.: 822,840

[22] Filed: Aug. 8, 1977

[30] Foreign Application Priority Data

Aug. 12, 1976 [DE] Fed. Rep. of Germany ..... 2636273

[51] Int. Cl.$^2$ ..... C21D 1/56

[52] U.S. Cl. ..... 148/16.5; 148/20.3

[58] Field of Search ..... 266/251; 148/16.5, 20.3

[56] References Cited

U.S. PATENT DOCUMENTS 3,693,409 9/1972 Yamagishi ..... 148/16.5

4,035,203 7/1977 L'Hermite et al. ..... 148/16.5

OTHER PUBLICATIONS

Metals Handbook, 8th ed., vol. 2, Heat Treating, Cleaning and Finishing, ASM, 1964.

*Primary Examiner*—L. Dewayne Rutledge
*Assistant Examiner*—John P. Sheehan
*Attorney, Agent, or Firm*—Martin A. Farber

[57] ABSTRACT

A method and apparatus for the control of the carburizing of parts under vacuum in a vacuum furnace, with which as a carbon carrier a hydrocarbon gas is introduced controlled in the furance. As the control quantity a soot mist formation is used in such a manner that the occurrence of the soot mist is determined, that upon the occurrence of the soot mist the hydrocarbon addition is completely or partially interrupted, and that the hydrocarbon addition is again received if the soot mist formation has dampened out.

6 Claims, 5 Drawing Figures

METHOD FOR CONTROL OF THE CARBURIZATION OF PARTS IN A VACUUM FURNACE

The invention relates to a method for the control of the carburizing of parts under vacuum in a vacuum furnace, with which as a carbon carrier a hydrocarbon gas is introduced controlled in the furnace.

Carburizing under vacuum and below atmospheric pressure, respectively, is known. For this as gaseous carburizing agents, hydrocarbons, in particular methane, are used. In the furnace several gas components are found, for example $CH_4$ and $N_2$ or $CH_4+CO+N_2+H_2$. Since with these methods chemical equilibrium does not set in between the gases and the desired carbon of the steel to be carburized, provision must be made for an oversupply of carbon in the gas, for example by $CH_4$. This necessary oversupply of hydrocarbons is connected with the disadvantage that during progress of the reaction, for example methane, $$CH_4=C+2H_2$$

free carbon develops which does not arrive at the steel surface. Soot arises from this free carbon. With higher concentration, this soot is optically visable on a soot cloud and has the disadvantage on the one hand of hindering the carburizing and on the other hand of soiling the parts to be treated and the furnace. Beyond this with the use of an electrically heated furnace a danger of a short circuit exists.

For reduction of the arising soot, the hydrocarbon gas has alredy been supplied to the furnace, pulsing in a constant manner or in a manner controlled according to quantity and time. An effective result however could not be achieved with this. Moreover it is disadvantageous with this method, that for the setting of certain or fixed carburization depths and certain edge carbon content, the requirement exists to empirically ascertain the pulsation sequence for the most different parts to be treated, in order to achieve a better overall result with respect to the soot formation. The dosing consequently is determined substantially empirically only with costly tests under difficult conditions. Moreover with the known control methods, it is established as necessary in order to suppress strong soot mist formation, to drive the pressure during the addition phase as low as possible (approximately 200 Torr), whereby however the carburizing speed is reduced and a poor uniformity of the carburization sets in on the steel surface, since the gas has a low density and consequently is to be distributed poorly uniformly in the heating space.

The invention is based on the task to produce an improved control for carburization at below atmospheric pressure for the purpose of shortening of the soot formation phase.

The task is solved in accordance with the invention by the introductory described method in the manner that as the control quantity, the soot mist formation is used in such a manner that over the treatment time period, the occurrence of the soot cloud is optically determined continuously and repeatedly. The addition of hydrocarbons with the first occurrence of the soot mist is completely or partially interrupted and is received again if the soot mist formation has decayed out. The occurrence of the soot mist can be determined according to per se known methods. Besides ionization- or conductivity-measurements of the gas, an optical measurement by means of a photoelectric device or light gate comprising a light transmitter and a photodetector is preferred, the interruption of which by the occurrence of the soot mist releases a control signal which is used for the complete or partial termination of the hydrocarbon addition. If the interruption of the photoelectric device is neutralized with the decay of the soot mist formation, the addition of hydrocarbons again takes place.

With the control in accordance with the present invention, in an extraordinarily sensitive manner it is possible to control the hydrocarbon addition to the furnace at the limit of the soot mist formation and consequently to see to it that the $CH_4$-supply is utilized for the carburizing as near as possible according to the following formula $$CH_4==C+2\ H_2,$$

whereby the carbon is received in an optimum quantity up to saturation of the austenite of the steel.

A soot mist formation, is almost avoided in the initial condition so that the heretofore to be tolerated arresting of the carburization, the furnace soiling, the soiling of the parts as well as the short circuit danger are eliminated with electrical heating elements.

In the practical embodiment it can be driven for example with approximately 460 Torr. In this manner with a carburization time of one hour, a $CH_4$ addition is fed in approximately four times to five times or also more often depending on the sensitivity of the control. Likewise the duration of the $CH_4$ addition is different depending on the sensitivity of the control and can amount to approximately 1 minute according to rough estimate values, whereas the interrupted or turned-off time can amount to approximately 10 minutes. Other more exact values result from the tests described in connection with the description of the apparatus. In connection with the carburizing time, the edge carbon content is brought to the desired value by means of diffusion under high vacuum.

Further particulars, features and advantages of the invention follow from the following description of the corresponding drawings in which a preferred embodiment form of a control device is illustrated. In the drawings.

Figure 1:
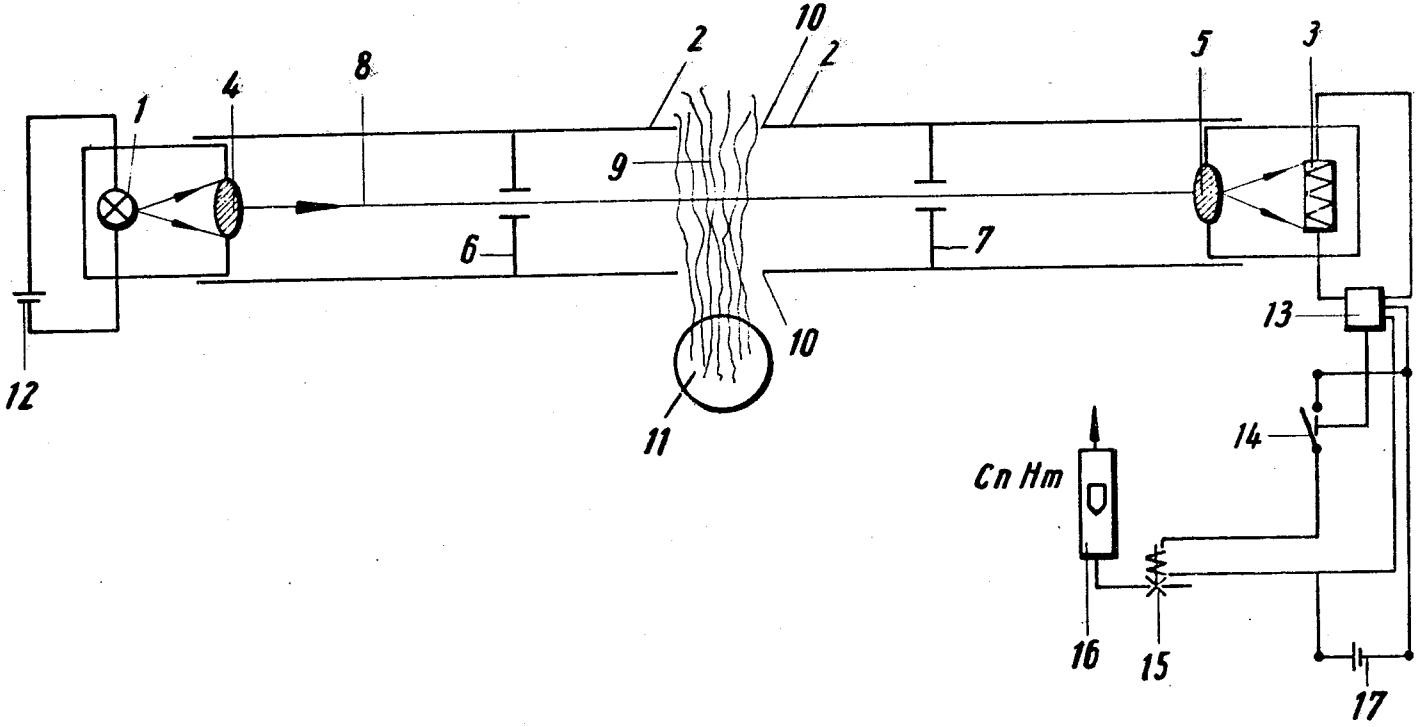
FIG. 1 is a schematic view of an apparatus for the control of the carburizing of parts under vacuum in a vacuum furnace.

In FIG. 1 of the drawings a light transmitter 1 is illustrated the beam course of which is guided by a protection tube 2 to a light receiver or photodetector 3. Lenses 4 and 5 as well as screens 6 and 7 are arranged as optical devices in the protection tube 2 in order to produce an unobjectionable reproducible beam course.

The light gate or photoelectric device 8, indicated in the drawing by an arrowed line, including the radiation beam which runs from the light transmitter 1 to the light receiver 3, can be interrupted by the soot mist 9 which occurs in the manner such that the protection tube 2 is connected, via openings 10, to the furnace chamber, which schematically is indicated in the drawing by a heating chamber 11.

In order to obtain a determination of the soot mist by the interruption of the light gate or photoelectric device 8 immediately upon the occurrence of the soot mist, and according to desire a complete or partial interruption of the hydrocarbon addition, and the reception of the hydrocarbon addition once more after the decay of the soot mist formation, the control mimic is provided which can be recognized in the drawing. According to this, the light transmitter 1 receives its operating current from a current source 12 and the light receiver is connected to an amplifier 13 with a relay, which amplifies the signal for the opening of a control switch 14, which signal is produced by interrupting the light gate 8 from the light receiver 3, whereby an electromagnet valve 15 is closed, the electromagnet valve being inserted in the feed conduit 16 for the hydrocarbon gas to the furnace space. At the moment of interruption of the light gate photoelectric device 8 by the soot mist 9, consequently, according to desire the hydrocarbon addition is interrupted. The operating current of the receiver- and control- system is maintained by a current source 17.

It may be recognized that with the decay of the soot mist formation, the light receiver 3 again receives the photoelectric device 8, whereby the control switch 14 is closed and the magnetic valve 15 is opened so that the supply of hydrocarbon gas again is introduced.

With the above described apparatus, the control of a maximum carbon supply of a carbonization gas was examined by test. The control and the device for performing the control were proven. The following examples explain the results which were achieved:

EXAMPLE 1

In three tests with the same set parameters the repeatability of the carburizing result was examined. As constant set parameters, the following data was maintained:

| | |
|---|---|
| Preheating: | 840° C./15 Min. |
| | 1040° C./25 Min. |
| Vacuum: | $10^{-2}$ Torr |
| Carburizing: | T = 1040° C. |
| | $P_{CH_4}$ = 330 mbar |
| | $P_{N_2}$ = 330 mbar |
| | $t_s$ = 1 hour |
| | $t_{Diff}$ = 1½ hour |

The carburizing was carried out with a gas mixture of $N_2$ and $CH_4$. The cooling resulted in $N_2$ up to 20° C. Then turn off tests were taken.

Hardening: 840° C./1 h

Quenching in Oil: 50° C.

Figure 2:
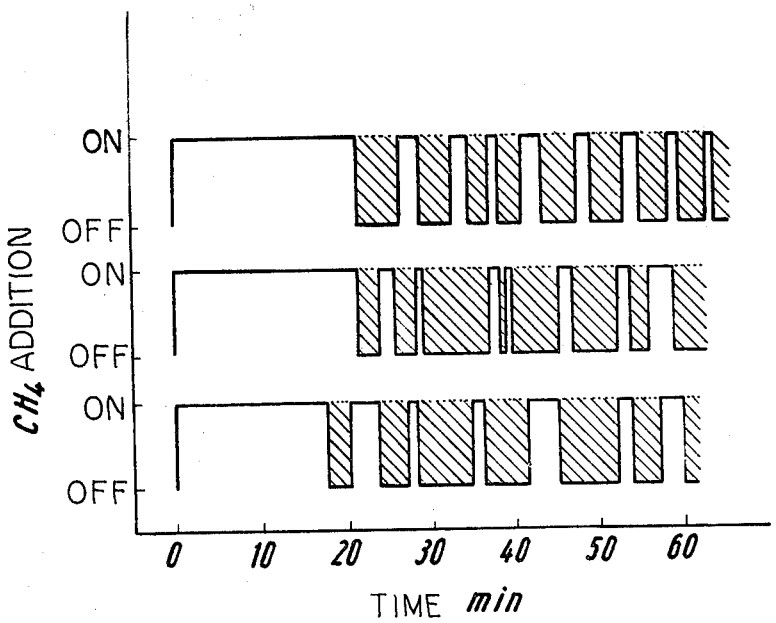
FIG. 2 is a graph illustrating the $CH_4$ addition vs. time of three tests.

The results are illustrated in FIGS. 2 to 5. In FIG. 2 the optical control of the $CH_4$ addition is graphically applied in dependency on the duration of the test. Consequently the beginning of the carburizing phase corresponds to the instant 0 in FIG. 2. The ratio of the turned on time to the turned off time varies about 50%. The duration of the turned on period varies between 0.5 minutes and 20 minutes.

In FIG. 2 of the drawing the inclined dashed field signifies the occurrence of soot. The three tests are illustrated one above the other such that the lowermost illustration signifies the evaluation of the first test, the middle illustration that of the second test and the uppermost illustration that of the third test. With all three tests substantially the same values are obtained, namely with the first test an edge carbon content of 0.89% C, during the second test of 0.88% C and during the third test an edge carbon content of 0.86% C. If one compares these results with results produced with pulsation control with fixed intervals according to the state of the art, thus the surprising technical advance can be recognized. Also furnace and parts optically show a substantially lower sooting.

Figure 3:
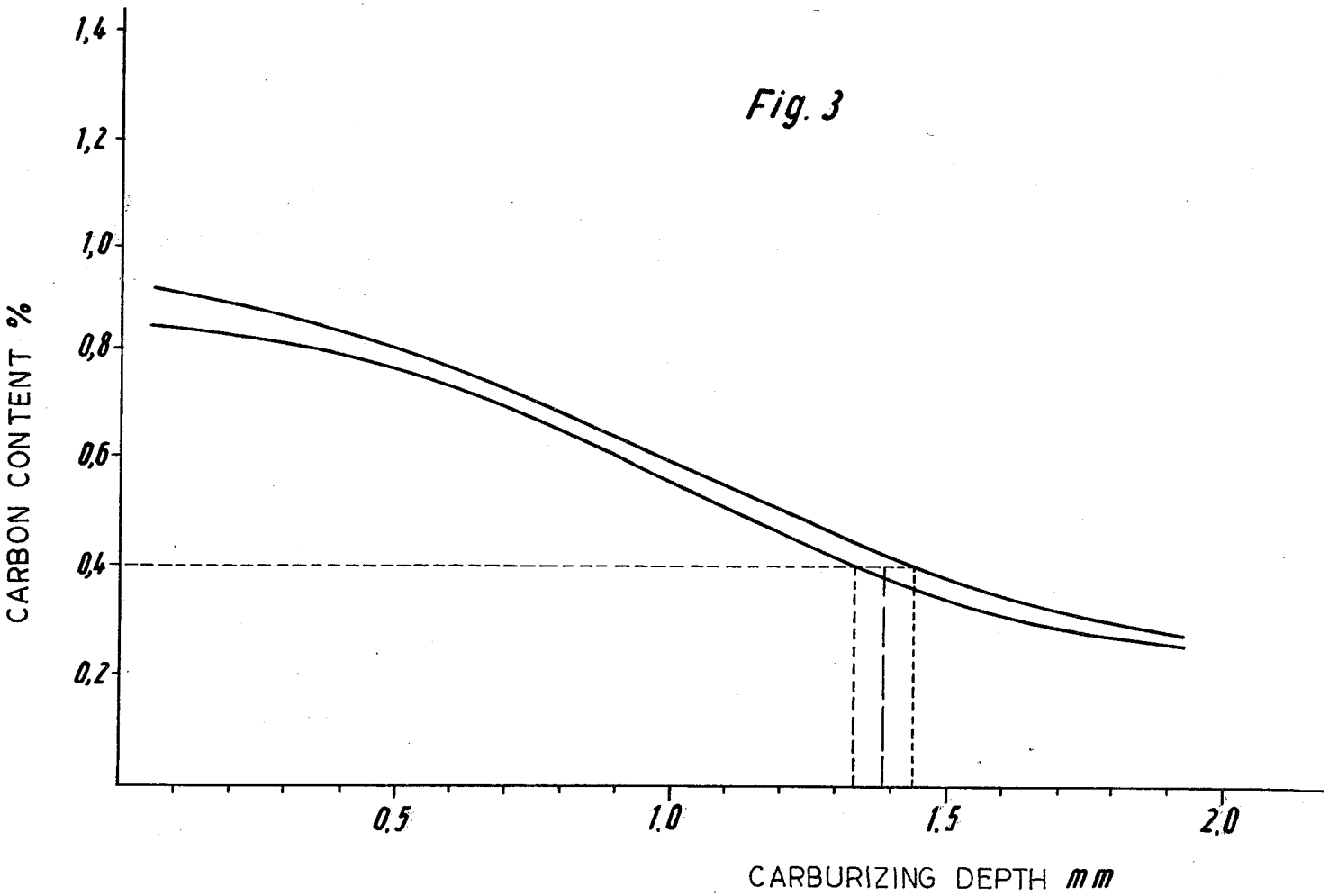
FIG. 3 is a graph of carbon content vs. carburizing depth illustrating the carbon course curves from samples made of work material C 20.

FIG. 3 of the drawing illustrates the carbon course curves from turned-off samples made of work material C 20. Thereby, in three tests the carbon determination was undertaken with constant parameters. The vacuum carburizing was performed with the following values:

T = 1040° C.
$t_s$ = 1 hour
$t_{Diff}$ = 1.5 hours
$CH_4$ = 240–250 Torr
$N_2$ = 240–250 Torr It was ascertained that the effective carburizing depth (C=0.4%) lies at 1.39±0.05 mm corresponding to ±3.6%. From each test only one sample was analyzed from the cage center. All measured values lie within the two curves indicated in FIG. 3.

Figure 4:
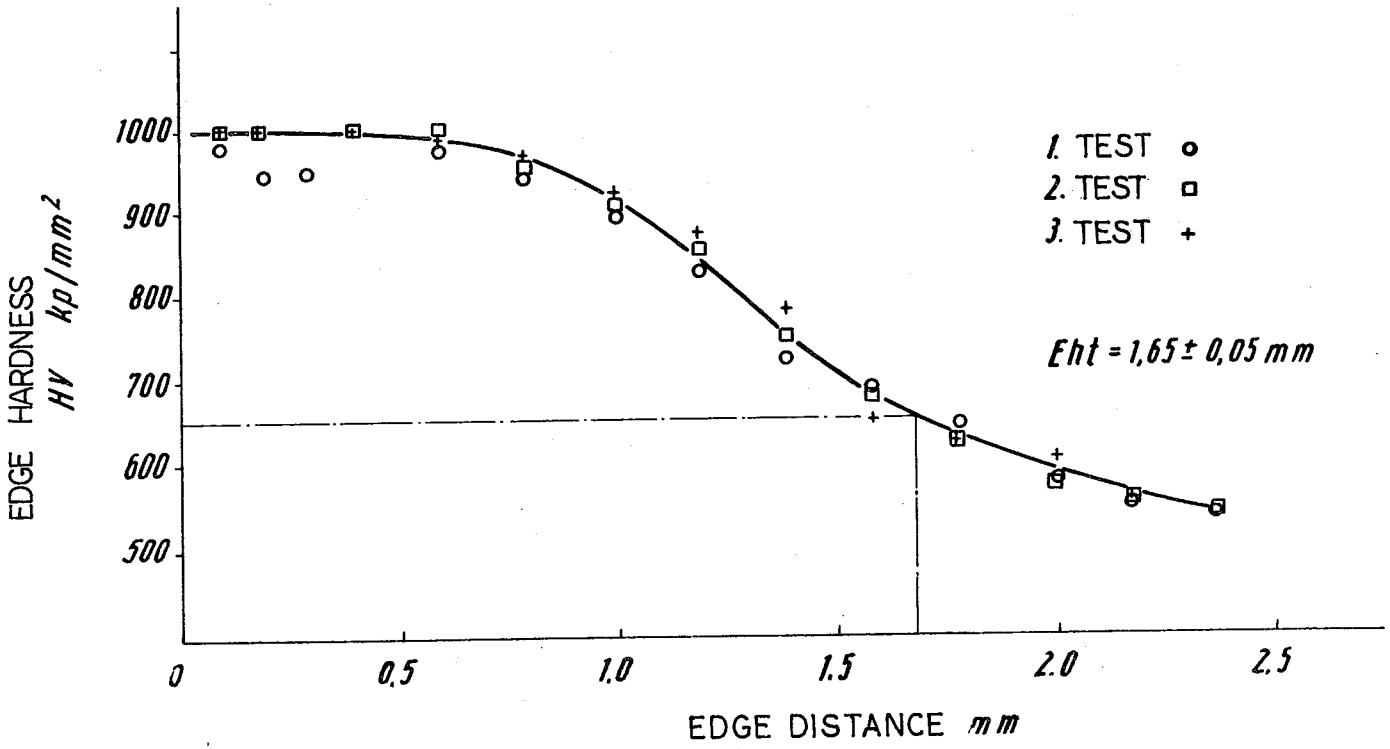
FIG. 4 is a graph of edge hardness vs. edge distance illustrating the hardening course on cam shafts made of C 20.

In FIG. 4 of the drawing the hardening course was measured on cam shafts made of C 20. The cam shafts were moved together with the probe sample in the same charge. The case hardening depth Eht was measured at 1.65±0.05 mm with a small variation of ±3%, whereby extraordinarily narrow limits were maintained.

EXAMPLE 2

In a series of five tests the reproducibility of the carburizing was ascertained with the help of carbon-course curves. For this, cylindrical bodies were used as turn-off samples with the dimensions 50 mm $\phi \times 50$ mm length from the three workpieces C 20, 16 $M_n$ Cr 5 as well as SAE 8620 (20 Ni Cr Mo 2).

The parameters, furnace temperature, switching condition of the sootsensor as well as the pressure course of the carburizing gases, were registered with a compensation-printer. The starting data for the tests were:

| Preheating at 850° C. / 40 minutes and 1040° C. / 25 minutes | |
|---|---|
| Carburizing gas: | 1040° C. / 60 minutes |
| | 1.8 $Nm^3/h$ $CH_4$ = 400 mbar |
| | 1.2 $Nm^3/h$ $N_2$ = 268 mbar |
| | P total = 668 mbar |
| Quenching: | in $N_2$ |

Figure 5:
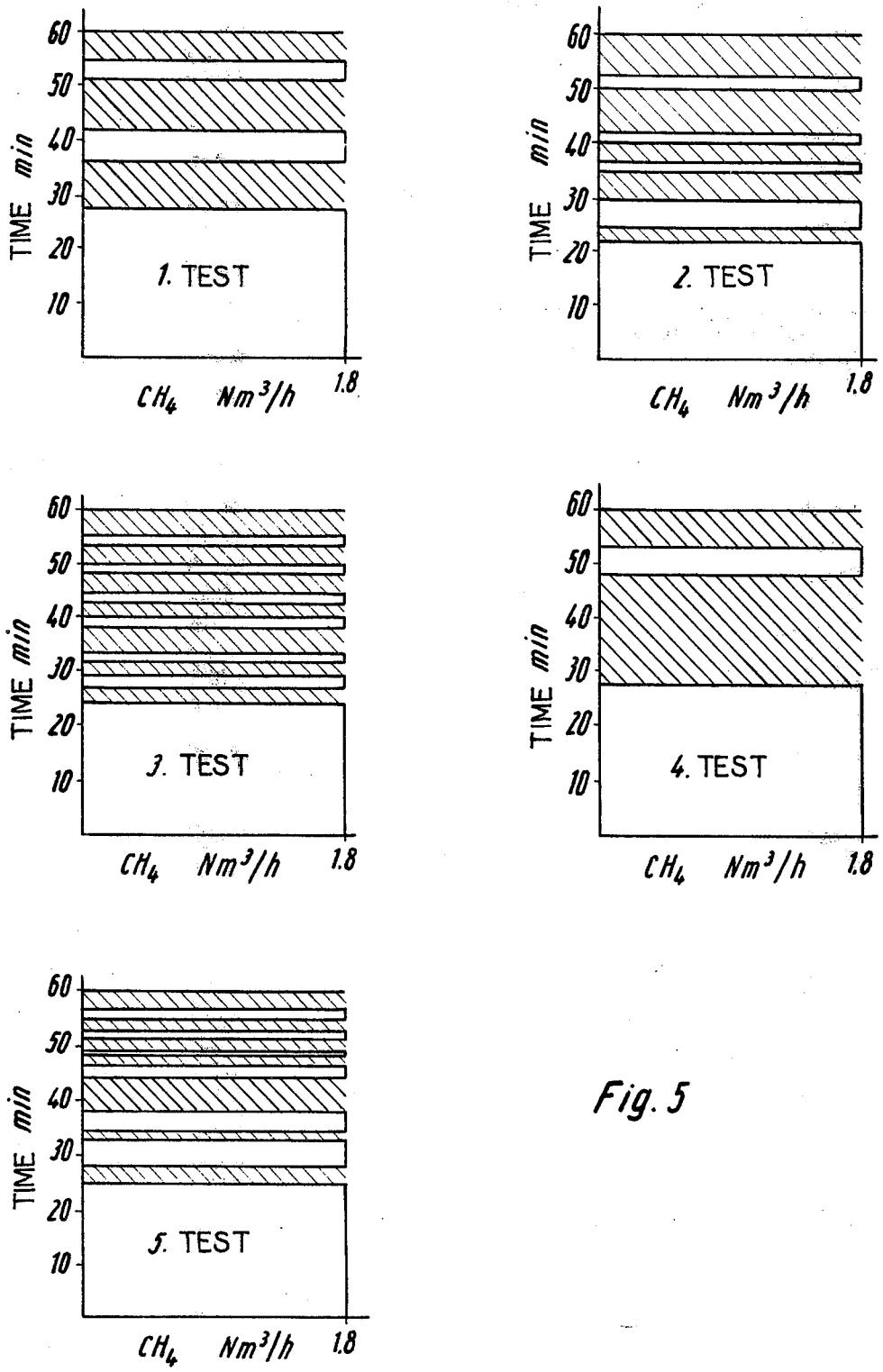
FIG. 5 graphically illustrates five of the test processes for comparison.

In the drawing FIG. 5, the five test processes are assembled. The temperature was maintained in the range of 1045° C. to 1035° C. and the carburizing duration was maintained in intervals of 59 minutes to 63 minutes. From the recording over the switching condition of the soot sensor according to FIG. 1 of the drawing the following results may be read:

| | | | |
|---|---|---|---|
| 1st test | 42 minutes ON | 23 minutes | OFF |
| 2nd test | 35 minutes ON | 24 minutes | OFF |
| 3rd test | 38.5 minutes ON | 23.5 minutes | OFF |

-continued

| | | | |
|---|---|---|---|
| 4th test | 43 minutes ON | 18 minutes | OFF |
| 5th test | 41 minutes ON | 21 minutes | OFF |

The number of switching actuations, as well as the turned on duration of the pulses are different. While in the 3rd and 5th tests the photoelectric device interrupted the $CH^4$ feed seven times because of soot, this occurred only twice in the 4th test. The edge carbon varied between 1.6% C±0.1% C and the case hardening depth varied between 0.9–1.0 mm. After a one hour diffusion at 1040° C., an edge-C value of 0.9% was set and the carburizing depth (0.4% C) amounted to 1.35 mm. A comparison of the pulses series of the soot sensor permits recognization that, in spite of the same carburizing gas compositions and carburizing gas pressures, the soot formation in the furnace atmosphere is indifferent and thus is not able to be calculated. The soot formation itself in the first place is caused by the level of the pressure of $CH_4(C_3H_8)$, however it is also dependent on the charge surface and the condition of the furnace chamber itself. With the control in accordance with the invention the carburizing may be controlled in vacuum with maximum speed, that is on the saturation limit of the carbon in the austenite. Steep carbon-course curves arise.

SUMMARY

The optical detection and control of the soot limit with the carburizing in vacuum permits a safe operation with reproducible results. Compared to the previously known methods, the following substantial advantages crystallize:

1. Maximum carburizing speed by a controlled carbon excess, which extends up to the soot limit.

2. The control is independent of the charge surface, carburizing gas quantity and the carburizing gas pressure as well as the chemical composition of the carburizing gas.

3. Low sooting of the furnace unit.

4. Independency of the condition of the treatment space (e.g. sooting by previous tests).

We claim:

1. A method for the control of the carburizing of parts under vacuum in a vacuum furnace during a treatment time period, comprising the steps of introducing and controlling a hydrocarbon gas addition into the furnace under vacuum pressure, repeatedly during a treatment time period comprising the steps of detecting the initiation of a soot mist formation in the furnace, as a control value, upon the occurrence thereof, at least partially interrupting the feeding of the hydrocarbon gas addition into the furnace upon the detection of the soot mist formation, and again introducing the hydrocarbon gas addition into the furnace as in the first-mentioned step when the soot mist formation has decayed out.

2. The method according to claim 4, wherein the step of detecting the soot mist formation is by optical measurement with a light gate comprising a light transmitter emitting light directed into a path of movement of the soot mist and a photodetector detecting the light, emitting a signal upon the interruption of the light upon the occurrence of the initiation of the soot mist formation, via the signal, causing the at least partial interruption of the hydrocarbon gas addition, and automatically terminating the interruption of the light upon decay of the soot mist formation and again causing the first-mentioned introduction of hydrocarbon gas addition into the furnace.

3. The method according to claim 1, wherein said step of at least partially interrupting the feed constitutes a total interruption of the feed of the hydrocarbon gas addition.

4. The method according to claim 3, wherein during the treatment time period the ratio of the time of interruption to the time of introduction of the feeding of the hydrocarbon gas addition varies between approximately 40% to 65%.

5. The method according to claim 3, wherein the treatment time period is approximately one hour and the first-mentioned step of introduction of the hydrocarbon gas addition occurs between about two to nine times.

6. The method according to claim 4, wherein the time duration of each time of introduction is approximately between 0.5 and 20 minutes.

* * * * *

UNITED STATES PATENT AND TRADEMARK OFFICE

CERTIFICATE OF CORRECTION

PATENT NO. : 4,168,186

DATED : September 18, 1979

INVENTOR(S) : Ferdinand Limque et al

It is certified that error appears in the above-identified patent and that said Letters Patent are hereby corrected as shown below:

Column 6 Line 17, (Claim 2) the number "4" should be --1--.

Column 5 Line 42 before "carburizing" (first occurrence) insert --the--.

Signed and Sealed this

*Fourth* Day of *December 1979*

[SEAL]

*Attest:*

SIDNEY A. DIAMOND

*Attesting Officer*

*Commissioner of Patents and Trademarks*